US009987861B2

(12) United States Patent
Ikeda et al.

(10) Patent No.: US 9,987,861 B2
(45) Date of Patent: Jun. 5, 2018

(54) DRYING DEVICE, COMPUTER READABLE MEDIUM STORING DRYING PROGRAM, DRYING METHOD AND IMAGE FORMING APPARATUS

(71) Applicant: FUJI XEROX CO., LTD., Tokyo (JP)

(72) Inventors: Chikaho Ikeda, Kanagawa (JP); Jun Isozaki, Kanagawa (JP); Yukari Motosugi, Kanagawa (JP); Akira Sakamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days. days.

(21) Appl. No.: 15/351,501

(22) Filed: Nov. 15, 2016

(65) Prior Publication Data

US 2018/0001667 A1 Jan. 4, 2018

(30) Foreign Application Priority Data

Jun. 30, 2016 (JP) ..... 2016-130539

(51) Int. Cl.
*B41J 11/00* (2006.01)
*B41M 5/00* (2006.01)

(52) U.S. Cl.
CPC ..... *B41J 11/002* (2013.01); *B41M 5/0017* (2013.01)

(58) Field of Classification Search
CPC ..... B41J 11/002
See application file for complete search history.

(56) References Cited

U.S. PATENT DOCUMENTS

| | | | | |
|---|---|---|---|---|
| 9,321,282 | B2 | 4/2016 | Isozaki et al. | |
| 2015/0251449 | A1* | 9/2015 | Isozaki | B41J 11/002 347/102 |
| 2016/0082748 | A1 | 3/2016 | Zengo et al. | |

FOREIGN PATENT DOCUMENTS

| | | |
|---|---|---|
| JP | 2015-168174 | 9/2015 |
| JP | 2016-64565 | 4/2016 |

* cited by examiner

*Primary Examiner* — Jason Uhlenhake
(74) *Attorney, Agent, or Firm* — Fildes & Outland, P.C.

(57) ABSTRACT

A drying device includes: a plurality of laser elements that emit laser beams with controllable intensity and respectively emit the laser beams such that the emitted laser beams partially overlap one another; and a controller that controls the intensity of the laser beams emitted from the plurality of laser elements so as to obtain intensity corresponding to drying intensity set as intensity for drying liquid droplets in a case where at least a part of an image region formed by the liquid droplets ejected in accordance with image information is included in an irradiation region of the laser beams emitted from the plurality of laser elements.

10 Claims, 10 Drawing Sheets

DRYING DEVICE, COMPUTER READABLE MEDIUM STORING DRYING PROGRAM, DRYING METHOD AND IMAGE FORMING APPARATUS

CROSS-REFERENCE TO RELATED APPLICATIONS

This application is based on and claims priority under 35 USC 119 from Japanese Patent Application No. 2016-130539 filed on Jun. 30, 2016.

BACKGROUND

Technical Field

The present invention relates to a drying device, a computer readable medium storing drying program, a drying method and an image forming apparatus.

SUMMARY

According to an aspect of the invention, there is provided a drying device of a first aspect of the invention comprising: plural laser elements that emit laser beams with controllable intensity and respectively emit the laser beams such that the emitted laser beams partially overlap one another; and a controller that controls the intensity of the laser beams emitted from the plural laser elements so as to obtain intensity corresponding to drying intensity set as intensity for drying liquid droplets in a case where at least a part of an image region formed by the liquid droplets ejected in accordance with image information is included in an irradiation region of the laser beams emitted from the plural laser elements.

BRIEF DESCRIPTION OF THE DRAWINGS

Exemplary embodiments of the present invention will be described in detail based on the following figures, wherein.

DESCRIPTION OF REFERENCE NUMERALS AND SIGNS

Figure 1:
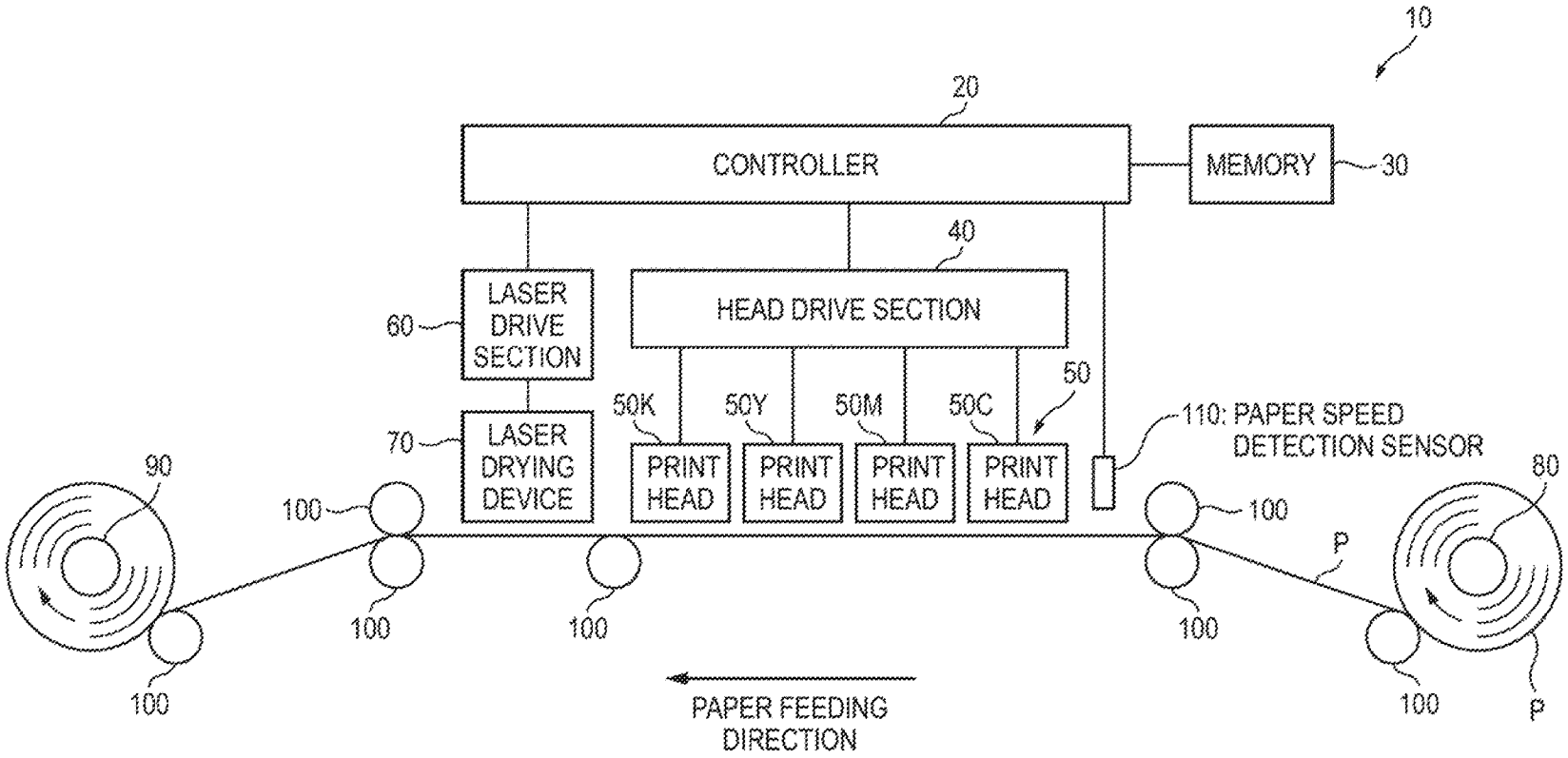
FIG. 1 is an outline configuration diagram illustrating an example of main components in an ink-jet recording apparatus.

10: ink-jet recording apparatus
20: computer (controller)
30: memory
40: head drive section
50: print head
60: laser drive section
70: laser drying device
201: CPU
202: ROM
203: RAM
LB: laser element block
LD: laser element
P: continuous-form paper

DETAILED DESCRIPTION

Hereinafter, description will be given of an exemplary embodiment of the invention. The same reference numerals will be given to components and processing with the same effective functions, and overlapping description will be appropriately omitted in some cases.

FIG. 1 illustrates an exemplary outline configuration diagram illustrating main components in an ink-jet recording apparatus 10 according to the exemplary embodiment.

The ink-jet recording apparatus 10 includes a controller 20, a memory 30, a head drive section 40, print heads 50, a laser drive section 60, a laser drying device 70, a paper supply roll 80, a discharge roll 90, a feeding roller 100, and a paper speed detection sensor 110, for example.

The controller 20 controls rotation of the feeding roller 100 connected to a paper feeding motor via a mechanism such as a gear by driving the paper feeding motor, which is not illustrated in the drawing. An elongated continuous-form paper P as a recording medium is wound around the paper supply roll 80 in a paper feeding direction, and the continuous-form paper P is fed in the paper feeding direction in conjunction with rotation of the feeding roller 100.

The controller 20 obtains information of an image that a user desires to depict on the continuous-form, paper P, that is, image information stored in the memory 30, for example, and controls the head drive section 40 based on color information for each pixel of the image included in the image information. Then, the head drive section 40 drives the print heads 50 connected to the head drive section 40 in accordance with ink droplet ejection timing instructed by the controller 20, causes the print heads 50 to eject ink droplets, and forms the image corresponding to the image information on the continuous-form paper P fed.

The color information for each pixel in the image information includes information that uniquely indicates color of each pixel. In the example of the exemplary embodiment, color information for each pixel is represented by concentration of each of yellow (Y), magenta (M), cyan (C), and black (K). However, another expression method of uniquely indicating colors of the image may be used.

The print heads 50 includes four print heads 50Y, 50M, 50C, and 50K respectively corresponding to four colors, namely, the Y color, the M color, the C color, and the K color, and ejects ink droplets of corresponding colors from ink ejection ports provided at the print heads 50 of the respective colors. In the example illustrated in FIG. 1, a case where the print heads 50 of the respective colors are provided in the feeding direction in an order of the K color, the Y color, the C color, and the M color is exemplified. A drive method for causing the print heads 50 to eject the ink droplets is not particularly limited, and a known method such as a so-called thermal scheme or a piezoelectric scheme is applied.

The laser drive section 60 includes a switching element such as a Field Effect Transistor (FET) that controls ON and OFF of laser elements included in the laser drying device 70. The laser drive section 60 adjusts irradiation intensity of a laser beam emitted from the laser elements by driving the switching element based on an instruction from the controller 20 and controlling a duty ratio of a pulse. Specifically, the irradiation intensity of the laser beam decreases as the duty ratio of the pulse decreases, and the irradiation intensity of the laser beam increases as the duty ratio of the pulse increases.

The controller 20 controls the laser drive section 60 such that the laser drying device 70 emits a laser beam toward an image formation surface of the continuous-form paper P, dries the ink droplets of the image formed on the continuous-form paper P, and fixes the image on the continuous-form paper P. A structure including the laser drive section 60 and the laser drying device 70 is referred to as a drying device. The image formation surface means a surface on the side, on which an image is formed, of the continuous-form paper P. A region, in which an image can be formed, on the continuous-form paper P (image formation surface) means an image formation region. That is, the image formation region means a region, in which an ink image can be formed by ink droplets ejected in accordance with the image, on the continuous-form paper P.

The distance from the laser elements to the continuous-form paper P of the laser drying device 70 is set based on a radiation angle of the laser elements and how large radiation region is.

The continuous-form paper P is fed to the discharge roll 90 in conjunction with rotation of the feeding roller 100 and is wound around the discharge roll 90.

The paper speed detection sensor 110 is arranged at a position facing the image formation surface of the continuous-form paper P, for example, and detects a feeding speed of the continuous-form paper P in the feeding direction. The controller 20 calculates timing at which the ink droplets ejected from the print heads 50 onto the continuous-form paper P are fed to the inside of the laser irradiation region of the laser drying device 70 by using the feeding speed provided from the paper speed detection sensor 110 and the distance from the print heads 50 to the laser drying device 70. Then, the controller 20 controls the laser drive section 60 such that the laser drying device 70 irradiates the ink droplets with the laser beam at the timing at which the ink droplets on the continuous-form paper P are fed to the inside of the laser irradiation region 70.

A method of detecting the feeding speed of the continuous-form paper P by the paper speed detection sensor 110 is not particularly limited, and a known method is applied. Also, the paper speed detection sensor 110 is not essential for the ink-jet recording apparatus 10 according to the exemplary embodiment. In a case where the feeding speed of the continuous-form paper P is determined in advance, it is not necessary to provide the paper speed detection sensor 110 in some cases.

Although there are water-based ink, oil-based ink as ink from which a solvent is evaporated, an ultraviolet curable ink, and the like, it is assumed that water-based ink is used in the exemplary embodiment. Hereinafter, simple expression of "ink" or "ink droplets" means "water-based ink" or "water-based ink droplets". An infrared (IR) absorbing agent is added to the ink of the YMCK colors to adjust degrees of laser beam absorption of the ink. However, the IR absorbing agent is not necessarily added to the ink of the YMCK colors.

As described above, the ink-jet recording apparatus 10 includes the laser drying device 70 that dries the ink droplets ejected onto the continuous-form paper P.

Next, description will be given of the laser drying device 70 according to the exemplary embodiment.

Figure 2:
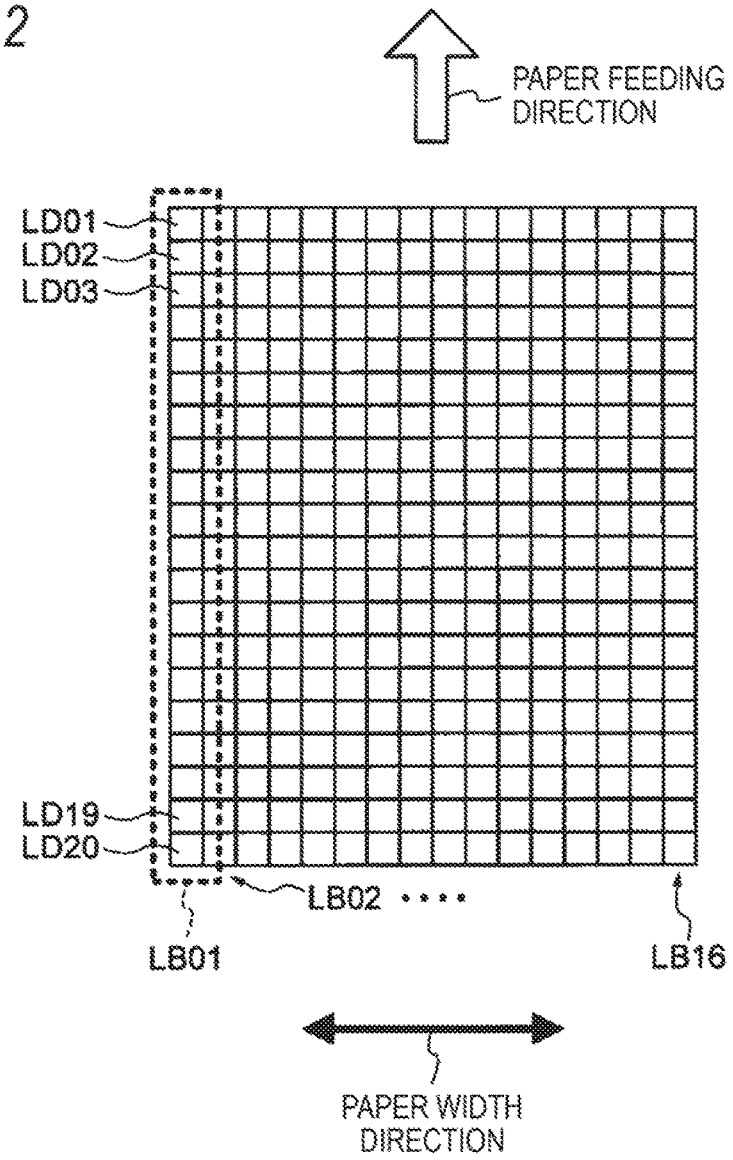
FIG. 2 is a diagram illustrating an example of a laser irradiation surface of a laser drying device.

FIG. 2 illustrates an example of a laser irradiation surface of the laser drying device 70. Here, the laser irradiation surface means a surface from which plural laser elements LD provided so as to face the image formation surface of the continuous-form paper P emits a laser beam.

As illustrated in FIG. 2, the plural laser elements LD are arranged in the paper feeding direction and the paper width direction on the laser irradiation surface of the laser drying device 70. The laser drive section 60 controls laser irradiation timing and laser beam irradiation intensity of the plural laser elements LD. In addition, a predetermined plural number of the laser elements LD are grouped into a laser element block LB in the paper feeding direction, and each laser element block is collectively driven by the laser drive section 60. Therefore, each laser element block LB functions as a laser element group that is turned on or off at the same time.

In the example illustrated in FIG. 2, a case is illustrated in which a laser element group including twenty laser elements LD01 to LD20 in the paper feeding direction is regarded as a laser element block LB as an example of the plural laser elements LD, and 320 laser elements disposed in sixteen blocks (laser element blocks LB01 to LB16) in the paper width direction forms the laser drying device 70. It is a matter of course that the number of the laser elements LD included in each laser element block LB and the number of the laser element blocks LB illustrated in FIG. 2 are not limited. A case of using a laser unit in which the interval in the paper width direction, namely the interval in the laser element blocks LB is set to 1.27 mm for the plural laser elements LD will be described in the exemplary embodiment.

As the laser elements LD, surface emitting laser elements that surface-emit a laser beam are preferably used. For example, laser elements including a plural vertical resonator laser elements arranged in the paper feeding direction and the paper width direction in a grid shape and is also referred to as Vertical Cavity Surface Emitting Laser (VCSEL) can be used as the surface emitting laser elements.

Incidentally, in a case where the laser element block LB are arranged such that the laser irradiation regions of the respective laser element blocks LB on the image formation surface of the continuous-form paper P are adjacent to each other without any gap in the paper width direction, the image formation surface of the continuous-form paper P are irradiated with laser beams in units of the laser irradiation regions of the respective laser element locks LB. However, the laser beams emitted have intensity distribution in which the intensity thereof is gradually weakened from the center. Therefore, the intensity of the laser beams varies on the image formation surface, which may lead non-uniform drying of the ink droplets.

Thus, the laser element blocks LB are located such that the plural laser beams overlap one another at least in the paper width direction so as to irradiate the image formation regions at least in the paper width direction with more laser beams in the exemplary embodiment. That is, the laser elements LD are disposed such that the image formation region in the paper width direction is irradiated with the overlapping laser beams from the plural laser elements at least in the paper width direction by paying attention to the radiation angle of the laser elements LD and how large the radiation region (on the continuous-form paper P) is.

Figure 3:
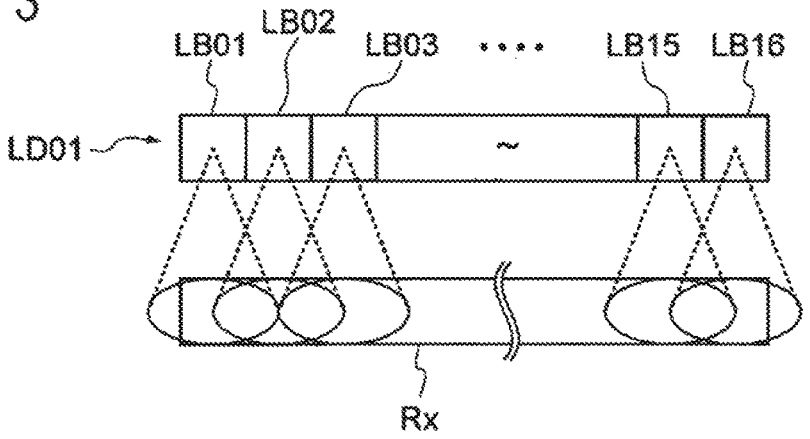
FIG. 3 is a diagram illustrating an example of a positional relationship between an image formation region and laser element blocks in a paper width direction.

FIG. 3 illustrates an example of a positional relationship between the image formation region and the laser element blocks LB in the paper width direction.

In the example illustrated in FIG. 3, the laser element blocks LB are provided such that an image formation region Rx in the paper width direction is irradiated with overlapping laser beams from the plural laser element blocks LB. That is, the distance between the laser elements LD and the continuous-form paper P is determined such that the continuous-form paper P is irradiated with the overlapping laser beams in consideration of profile (characterised by radiation angle) of the laser beams from the laser elements LD. In this manner, it is possible to cause the laser beams emitted to the continuous-form paper P to disperse from the laser beams in units of the laser element blocks LB to laser beams from the plural laser element blocks LB. In doing so, it is possible to suppress non-uniform drying of the ink droplets.

In a case of drying the ink droplets by using the laser drying device 70, the ink droplets included in the laser irradiation regions of the laser drying device 70 are dried. Therefore, it is necessary to examine how the laser irradiation regions in the laser drying device 70 are to be set and how the intensity of the laser beams in the laser irradiation regions is to be set in a case of drying the ink droplets by laser irradiation.

Figure 4:
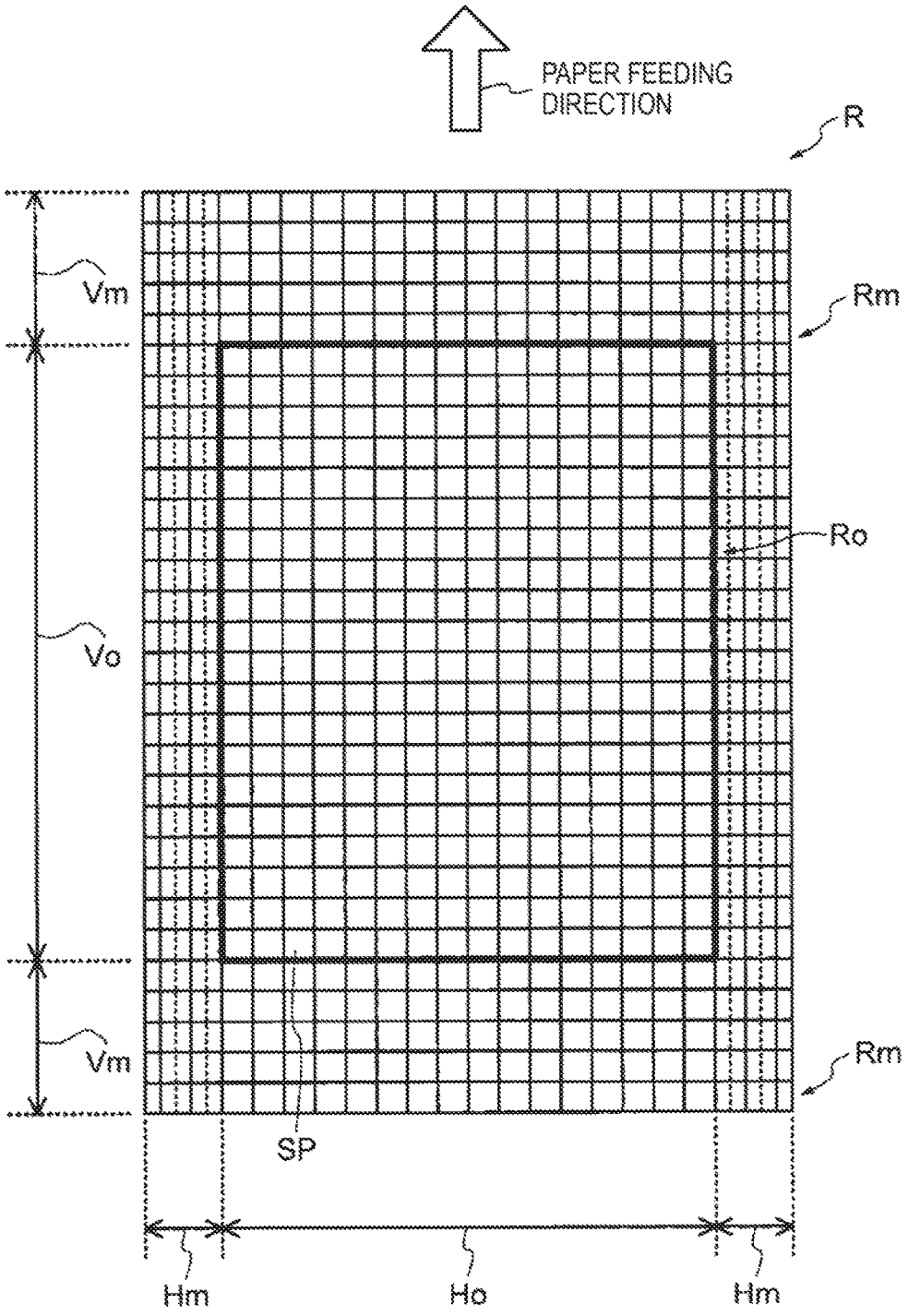
FIG. 4 is a diagram illustrating an example of a laser irradiation region by plural laser elements.

FIG. 4 illustrates an example of a laser irradiation region R by the plural laser elements LD.

In the exemplary embodiment, the respective laser beams emitted from the respective laser elements LD. In consideration of the respective laser beams profile, the laser irradiation region R is set so as to include a region Ro corresponding to the laser irradiation surface by the plural laser elements LD and a region Rm set on the periphery of the region Ro in consideration of the laser beams dispersion. The region Ro corresponds to the image formation region.

The region Ro is a region with a size corresponding to the laser irradiation surface, which is irradiated with the laser beams from the plural laser elements LD, on the continuous-form paper P. That is, the region Ro is set to have a size with a width Ho corresponding to the distance of the laser elements LD aligned in the paper width direction on the continuous-form paper P and a length Vo elongated or shortened in accordance with the feeding speed of the continuous-form paper F with respect to the distance of the laser elements LD aligned in the paper feeding direction. The continuous-form paper P is irradiated with the laser beams from the plural laser elements LD while fed. Therefore, energy of the laser beams emitted from the plural laser elements LD is accumulated on the continuous-form paper P. That is, it is important to review the cumulative energy (a product of irradiation intensity of irradiation time) given by the intensity of the laser beams (irradiation intensity) and the irradiation time of the laser beams in order to dry the ink droplets. Also, there is a region where the laser beams respectively emitted from, the plural laser elements LD are dominant in the region Ro.

Thus, the region Ro will be divided into units of the laser elements LD, and cumulative energy of the laser beams emitted in units of the divided sections will be examined in the exemplary embodiment. That is, the cumulative energy of the laser beams in units of sections SP with a size obtained by dividing the region Ro into sixteen sections (Ho/16) in the paper width direction and into twenty sections (Vo/20) in the paper feeding direction in the exemplary embodiment. The size of each section SP in the paper width direction is set to 0.635 mm, for example, as the interval of the laser elements LD in the paper width direction. The size of each section SP in the paper feeding direction is set to 1.89 mm that is an arrangement interval of the laser elements LD01 to LD20 aligned in the paper feeding direction.

There is a case where the cumulative energy based on the irradiation intensity of the laser beams between the laser elements LD in the paper width direction is taken into consideration for examining the cumulative energy in the region Ro in detail. In such a case, the division may be made with a predetermined multiple number of the number of the laser elements LD aligned in the paper width direction. For example, it is possible to suppress the non-uniform drying by taking the cumulative energy at portions corresponding to troughs of intensity of the laser beams between the laser elements LD in the paper width direction by dividing the irradiation region by a number that is a double of the number of the laser elements LD. Also, it is not necessary to perform operation for regions between the arrangement intervals by setting the length of the section SP in the paper feeding direction as the arrangement intervals of the laser elements LD.

In contrast, a region including predetermined sections is set for the region Rm in consideration of the laser beams profile on the periphery of the region Ro. In the exemplary embodiment, a region including a predetermined number of (five, for example) sections SP in the paper feeding direction and including a predetermined number of (five, for example) sections of ½ of the intervals in the paper width direction of the laser elements LD in the paper width direction, namely the sections with the size of ½ of the section SP in the paper feeding direction is determined. That is, the size of the region Rm is set by setting the width Hm corresponding to the distance of five sections, which has the size of ½ of the section SP, aligned in the paper width direction on both sides on the continuous-form paper P and the length Vm elongated or shortened in accordance with the feeding speed of the continuous-form paper P with respect to the distance of the five sections SP aligned on the upstream side and the downstream side in the paper feeding direction.

In the exemplary embodiment, the region Rm including the predetermined number of sections SP on the upstream side and the downstream side in the paper feeding direction is set as a target of examination so as to be able to consider an influence of laser beams leaking from the region Rm due to deviation of the examination target position on the paper from the region Vo in order to avoid an error in the calculation of the cumulative energy. However, the region Rm on at least one of the upstream side and the downstream side in the paper feeding direction may be ignored. This is because a result indicating that the cumulative energy calculation result is not much influenced by such ignorance of the region Rm is obtained since the light leaking to the outside of the region Vo did not significantly contribute in a state where the twenty laser elements are arranged in the paper feeding direction at the pitch of 1.89 mm as illustrated in FIG. 2. It is possible to suppress an calculation load by ignoring the region Rm in this manner.

Next, description will be given of a method of driving the laser drying device 70.

As described above, the laser drive section 60 according to the exemplary embodiment drives the laser element blocks LB such that the respective laser element blocks LB are turned on and off. Therefore, it is possible to suppress unnecessary laser irradiation of a region where no ink droplets are present in comparison to a case where all the laser element blocks LB included in the laser drying device 70 are collectively turned on and off. In doing so, energy consumption required for drying the ink droplets is reduced, and the ink droplets are efficiently dried.

The laser drive section 60 according to the exemplary embodiment calculates the amount of ink droplets at a position on an image by using image information. That is, the amount of ink droplets varies in accordance with the density of the image formed on the continuous-form paper P. Thus, the amount of ink droplets ejected onto a predetermined region on the continuous-form paper P in accordance with the image information is calculated. In such a case, the predetermined region is regarded as the section SP.

The laser drive section 60 turns on and off the laser element blocks LB to obtain the laser irradiation intensity in accordance with the amount of the ink droplets of the image. The laser drive section 60 calculates a duty of turning on and off the respective laser element blocks LB based on the amount of the ink droplets and the feeding speed of the continuous-form paper P. That is, the laser drive section controls the laser irradiation intensity so as to obtain necessary cumulative energy in accordance with the amount of the ink droplets of the image by turning on and off the laser element blocks LB while irradiation time required for (the image formation region on) the continuous-form paper P to pass through the laser irradiation region R in the paper feeding direction as cumulative time.

The laser drive section 60 may calculate a surface print rate of the image and turn on and off the laser element blocks LB in accordance with the calculated surface print rate of the image instead of turning on and off the laser element blocks LB in accordance with the amount of the ink droplets of the image. For example, the laser drive section 60 calculates the surface print rate of the image in advance based on the image information. Here, the print rate means a rate of portions where the ink droplets have actually landed with respect to the total number of portions where the ink droplets can land in a predetermined region on the continuous-form paper P. In such a case, the predetermined region is assumed to be the section SP. That is, the surface print rate of the image means a print rate (in the image formation region) on the continuous-form paper P included in the section SP determined so as to correspond to each of the laser elements LD when the image is formed on the image formation region on the continuous-form paper P.

The laser drive section 60 turns on and off the corresponding laser element blocks LB so as to obtain cumulative energy necessary for drying in accordance with the surface print rate of the image. In addition, the laser drive section 60 determines the laser irradiation intensity by further considering the feeding speed since for the duty of turning on and off the respective laser element blocks LB since the cumulative time for the paper passing through the laser irradiation region varies depending on the feeding speed of the continuous-form paper P. That is, the laser drive section 60 turns on and off the laser element blocks LB in accordance with the time required for (the image formation region on) the continuous-form paper P passing through the laser irradiation region R in the paper feeding direction and the surface print rate of the image.

Next, description will be given of a configuration of main parts in an electric system in the ink-jet recording apparatus 10.

Figure 5:
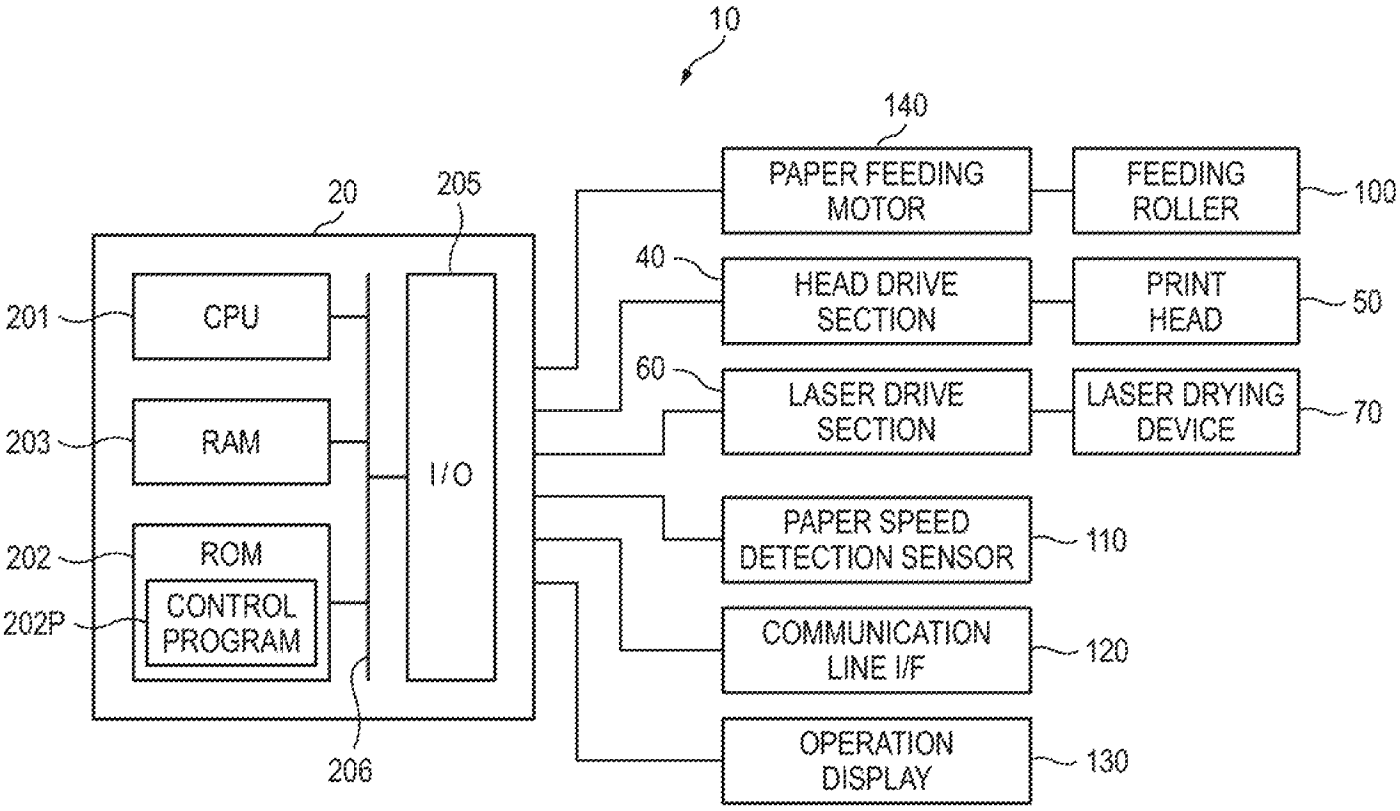
FIG. 5 is a diagram illustrating an example of a configuration of main parts in an electric system in the ink-jet recording apparatus.

FIG. 5 is an example illustrating an example of a configuration of main parts in an electric system in the ink-jet recording apparatus 10. The controller 20 can be realized by a computer, for example. Hereinafter, the computer that can be implemented as the controller 20 will be described as a computer 20 in the following description.

In the computer 20, a Central Processing Unit (CPU) 201, a Read Only Memory (ROM) 202, a Random Access Memory (RAM) 203, a non-volatile memory 204, and an input/output (I/O) interface 205 are connected to each other via a bus 206 as illustrated in FIG. 5. The head drive section 40, the laser drive section 60, the paper speed detection sensor 110, the communication line interface (I/F) 120, the operation display 130, and the paper feeding motor 140 are connected to the I/O 205. Furthermore, the print heads 50 is connected to the head drive section 40, and the laser drying device 70 is connected to the laser drive section 60. Also, the feeding roller 100 is connected to the paper feeding motor 140 via a drive mechanism such as a gear, and the feeding roller 100 rotates in conjunction with the drive of the paper feeding motor 140.

The computer 20 controls the ink-jet recording apparatus 10 by causing the CPU 201 to execute a control program 202P installed in advance in the ROM 202, for example, and performing data communication with the respective elements connected to the I/O 205 in accordance with the control program 202P.

The head drive section 40 includes the switching element such as an FET that turns on and off the print heads 50, for example, and drives the switching element in response to an instruction from the computer 20.

The print heads 50 include piezoelectric elements or the like that convert variations in the voltage into power, cause the piezoelectric elements or the like in accordance with an instruction for drive from the head drive section 40, and eject ink droplets supplied from an ink tank, which is not illustrated in the drawing, from the nozzle ejection ports of the print heads 50 toward the continuous-form paper P.

The laser drive section 60 includes a switching element such as an FET that turns on and off the respective laser element blocks LB included in the laser drying device 70, for example, and drives the switching element in response to an instruction from the computer 20.

The laser drying device 70 includes the laser element blocks LB, for example, and emits laser beams from, the laser element blocks LB toward the continuous-form paper P in accordance with an instruction for drive from the laser drive section 60.

The communication line I/F 120 is an interface which is connected to a communication line, is not illustrated in the drawing, and performs data communication with an information device such as a personal computer, which is not illustrated in the drawing, connected to the communication line. The communication line which is not illustrated in the drawing may be in any of a wired form, a wireless form, and a mixture form thereof, and may receive image information from the information device, which is not illustrated in the drawing, for example.

The operation display 130 receives an instruction from a user of the ink-jet recording apparatus 10 and provides various kinds of information related to an operation status and the like of the ink-jet recording apparatus 10 to the user. The operation display 130 includes a touch panel display that displays a display button for causing a program to realize reception of an operation instruction, for example, and various kinds of information and hardware such as a numeric keypad and a start button.

Processing of the ink-jet recording apparatus 10 including the aforementioned elements can be realized by software with the use of the computer 20 by executing the control program 202P.

The control program 202P is not exclusively provided in the form of being installed in advance in the ROM 202, and may be provided in the form of being stored in a computer-readable recording medium such as a CD-ROM or a memory card. Alternatively, the control program 202P may be distributed via the communication line I/F 120.

Next, description will be given of effects of the ink-jet recording apparatus 10 according to the exemplary embodiment.

Figure 6:
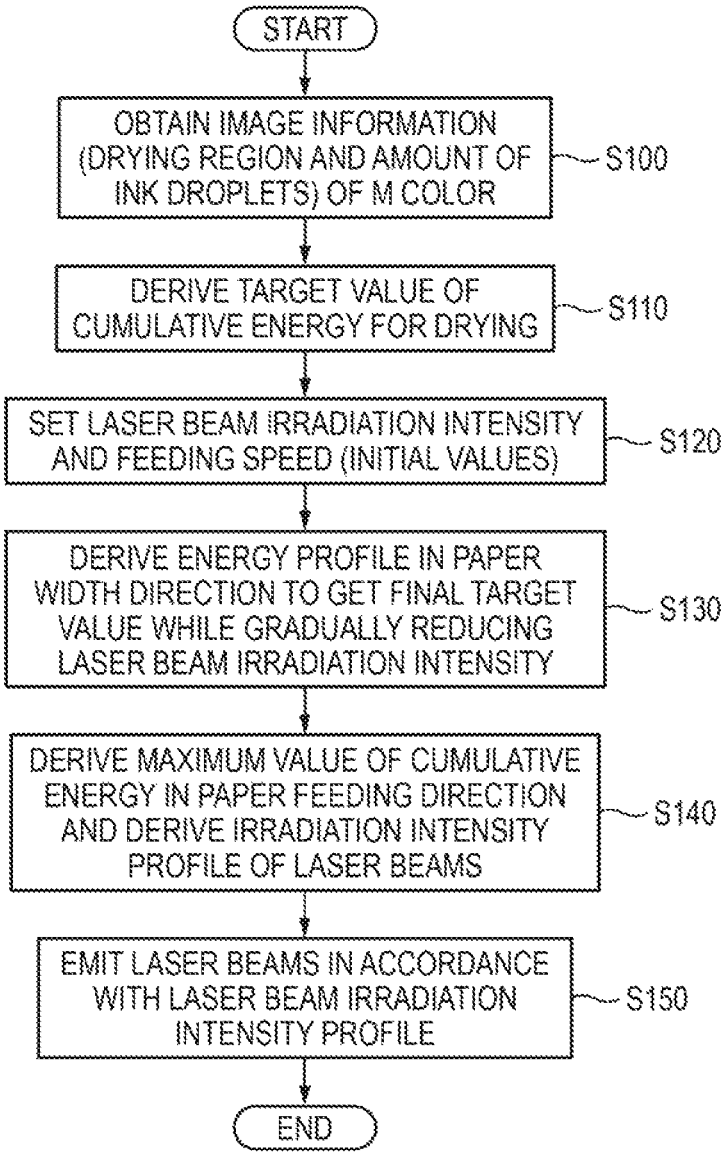
FIG. 6 is a flowchart illustrating an example of a flow of drying process according to an exemplary embodiment.

FIG. 6 illustrates a processing flow of a drying program as an example of the control program 202P that is executed by the CPU 201 in the computer 20 when image information to be formed on the continuous-form paper P is received from the user, for example.

For simple description, a case will be described in which drying processing of an image of M color ink formed immediately before the laser drying device 70 is performed.

First, in Step S100, M color image information stored in advance in a predetermined region in the RAM 203, for example, is obtained. For example, the M color image information includes various kinds of information indicating a drying region and the amount of ink droplets. The drying region means a position and a size of a region, in which an ink image has been formed by ejected ink droplets, in the image formation region. Since the amount of the ink droplets varies in accordance with the concentration of the image, the amount of the ink droplets is determined so as to correspond to the position (a pixel, for example) in the drying region. Therefore, the various kinds of information indicating the amount of the ink droplets are associated with the position (the pixel, for example) in the drying region.

In the next Step S110, cumulative energy for drying the M color ink image formed (in the image formation region) on the continuous-form paper P is derived by using the M color image information obtained in Step S100, and the derived value cumulative energy value is stored as a target value in the RAM 203. It is necessary to provide sufficient energy to dry the amount of the ink droplets of the M color in accordance with the M color image information in order to dry the ink droplets of the M color, and it is assumed to provide cumulative energy (a product of the irradiation intensity and the irradiation time) depending on the intensity of the laser beams (irradiation intensity) and the irradiation time of the laser beams in the exemplary embodiment.

Thus, the image information is determined in the predetermined region in the RAM 203 such that the amount and the arrangement of the ink droplets of the M color corresponding to the pixels of the image represented by the M color image information at the position of the image formed (in the image formation region) on the continuous-form paper P first in Step S110. The image information determined in the RAM 203 will be referred to as image data.

Then, the image data determined in the RAM 203 is divided into the size of the section SP corresponding to each laser element LD used in the laser drying device 70. The ink droplets of the M color of the amount indicated by the image data is calculated for each divided region corresponding to the size of the section SP, and the calculated amount of the ink droplets of the M color is associated and stored with each position of the section SP in the image formation region (the region Ro in the laser irradiation region R) IN THE ram 203.

Next, drying energy for drying the ink droplets of the amount is derived for each section SP. That is, energy for drying the ink droplets of the amount corresponding to each position of the section SP, which is set based on the intensity of the laser beams (irradiation intensity) and the irradiation time of the laser beam, for example, is derived as the drying energy for each section SP. The derived drying energy is stored as a target value of the cumulative energy for drying the ink droplets of the amount included in the section SP, in association with each position of the section SP in the RAM 203.

Figure 7:
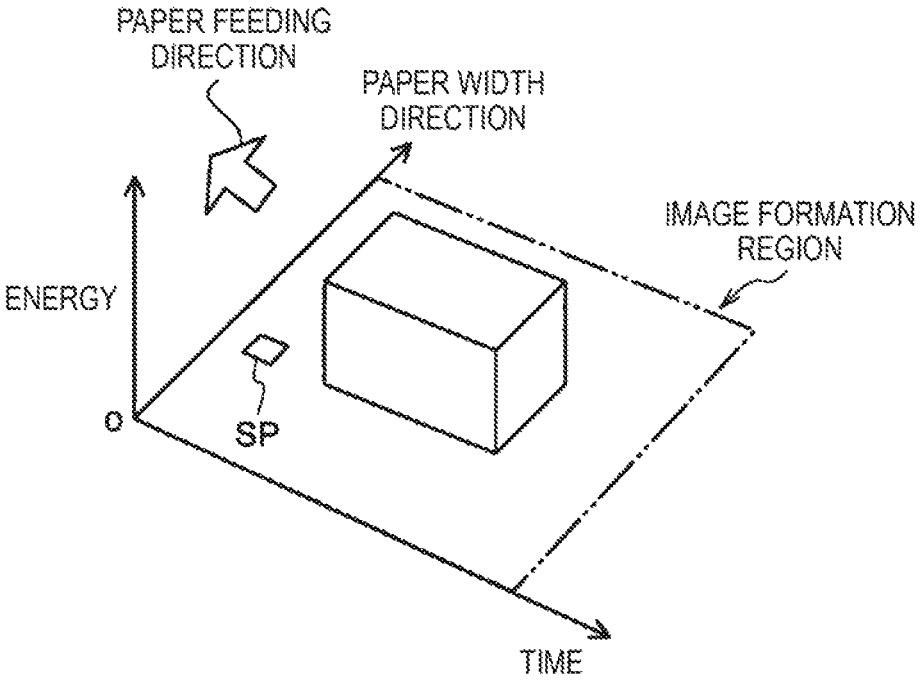
FIG. 7 is a diagram illustrating an example of energy in the image formation region, which has been derived as a target value.

FIG. 7 illustrates an example of energy in the image formation region, which has been derived as a target value.

Next, the laser irradiation intensity is calculated by repeated operations based on the cumulative energy target value at a specific position in the paper feeding direction in Steps S120 and S130. First, in Step S120, an initial value of the cumulative energy in the repeated operations is set based on the maximum irradiation intensity of the laser beams emitted from the laser element blocks LB at the maximum duty, for example, and the feeding speed at which the continuous-form paper P is fed in the paper feeding direction in order to derive the irradiation intensity of the laser beams emitted from the laser drying device 70. As to the feeding speed described herein, a predetermined feeding speed at which the continuous-form paper P is fed is assumed to be stored in advance in the ink-jet recording apparatus 10.

In the next Step S130, an energy profile in the paper width direction is derived to reach the target value while the irradiation intensity of the laser beams is gradually reduced by the repeated operations so as not to fall below the target cumulative energy. In the exemplary embodiment, the operation is significantly simplified by assuming the same value in the paper feeding direction and performing one-dimensional calculation only in the paper width direction to derive the cumulative energy for drying the M color ink image instead of performing two-dimensional calculation since the twenty laser elements are aligned in the paper feeding direction and are collectively controlled. The cumulative energy is derived in the one-dimensional direction in the paper width direction for the M color ink image, and determined the value in the paper feeding direction.

Thus, in Step S130, the cumulative energy in the one-dimensional direction in the paper width direction is derived across the paper feeding direction. More specifically, a cumulative energy profile in a case of emitting laser beams of initial value irradiation intensity to a group of continuing sections SP in the paper width direction in the image formation region on the continuous-form paper P from the laser element blocks LB while feeding the continuous-form paper P is derived. Then, the cumulative energy in the one-dimensional direction is derived across the paper feeding direction. Next, the irradiation intensity of the laser beams is reduced by predetermined irradiation intensity, and the deriving of the cumulative energy in the one-dimensional direction across the paper feeding direction is repeated. In this case, reduction of the irradiation intensity for a laser element block LB corresponding to a section in which the derived cumulative energy in the one-dimensional direction (paper width direction) falls below the target value is stopped. Then, a value that is equal to or greater than the target value obtained immediately before the cumulative energy falls below the target value is employed as the irradiation intensity to be obtained.

Figure 8:
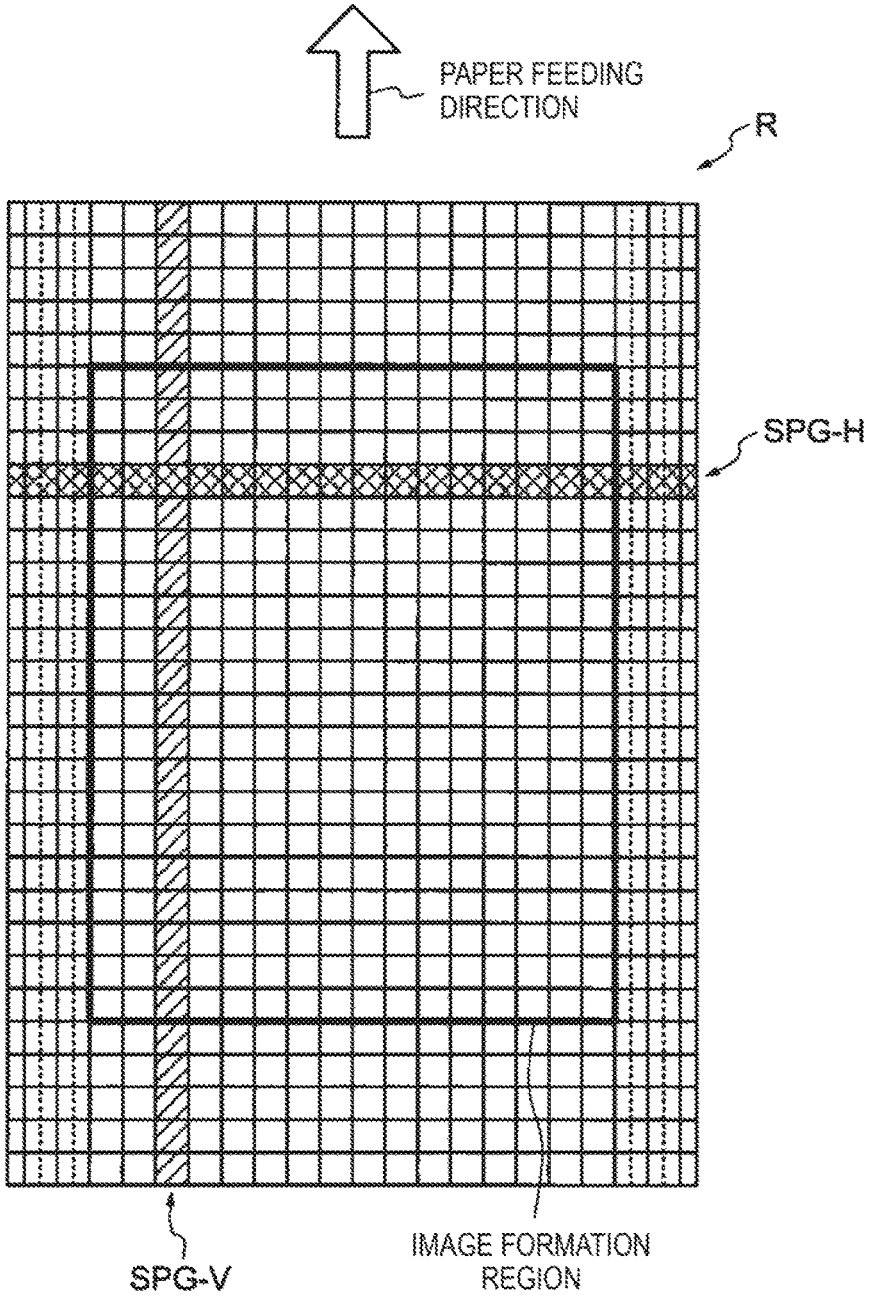
FIG. 8 is a diagram illustrating an example of a target region for which cumulative energy is derived.

FIG. 8 illustrates an example of a region as a target, for which cumulative energy is derived, in the image formation region on the continuous-form paper P. FIG. 8 illustrates a group SPG-H of the continuing sections SP in the paper width direction in the image formation region on the continuous-form paper P in a case of deriving the cumulative energy in the one-dimensional direction in the paper width direction across the paper feeding direction.

FIGS. 9A to 9D illustrates an example of a process for obtaining irradiation intensity of the respective laser elements LD for the group SPG-H of the sections SP from the cumulative energy as a target value by the repeated operations.

Figure 9A:
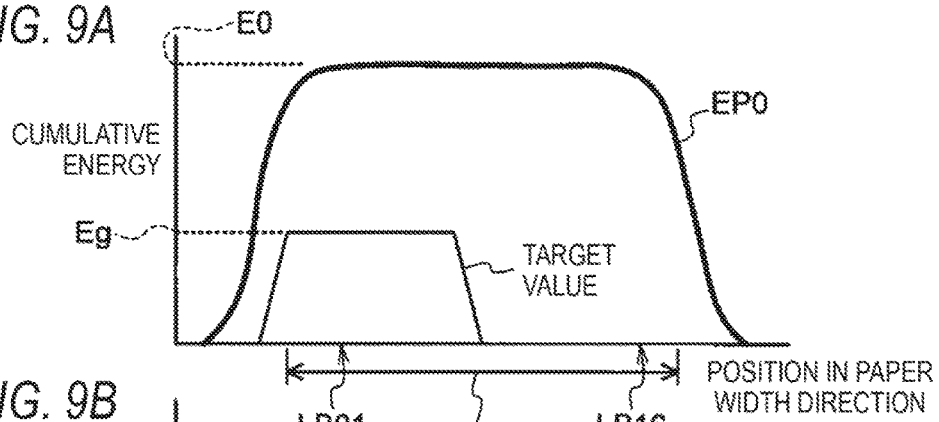
FIGS. 9A, 9B, 9C and 9D are diagrams schematically illustrating an example of a process for obtaining irradiation intensity of the laser elements.

In a case of setting all the laser elements at the maximum irradiation intensity as an initial value of the repeated operations and emitting laser beams from all the laser element blocks LB01 to LB16 while feeding the continuous-form paper P as illustrated in FIG. 9A, the group SPG-H of the sections SP is sequentially irradiated with the laser beams at the maximum irradiation intensity in the length direction of the laser element blocks LB from the respective laser elements LD in the paper width direction included in all the laser element blocks LB. In doing so, the cumulative energy in the group of the sections SP corresponding to the width Ho, namely in the image formation region in the paper width direction becomes cumulative energy E0 of accumulated energy from the laser beams at the maximum irradiation intensity. In such a case, an energy profile EP0 in the paper width direction is obtained as distribution of the cumulative energy in the paper width direction in the image formation surface.

Then, the energy profile EP0 is compared with the target value, and in a case where the cumulative energy in the paper width direction is equal to or greater than the target value, the irradiation intensity is reduced.

Figure 9B:
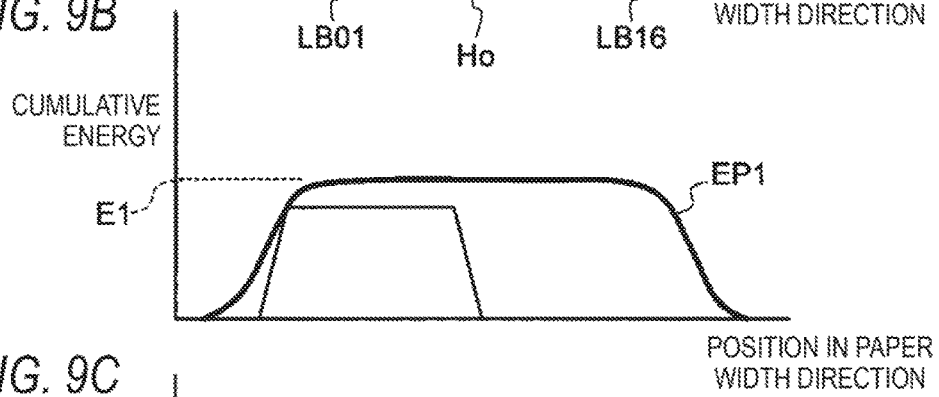

That is, the irradiation intensity of the respective laser elements LD is gradually reduced by the predetermined irradiation intensity for all the laser element blocks LB01 to LB16 until the energy profile EP0 is brought into contact with any position of the profile based on the target value as illustrated in FIG. 9B. In the example illustrated in FIG. 9B, the energy profile EP1 in the paper width direction of the cumulative energy E1 of cumulative energy by the laser beams at the irradiation intensity reduced from the maximum irradiation intensity by the predetermined irradiation intensity is in contact with the profile based on the target value.

Next, the reduction of the irradiation intensity for the plural laser element blocks LB related to the sections SP corresponding to the position of the energy profile EP1 in contact with the profile based on the target value is stopped, and the reducing of the irradiation intensity of the respective laser elements LD in the other laser element blocks LB by the predetermined irradiation intensity is sequentially repeated.

Figure 9C:
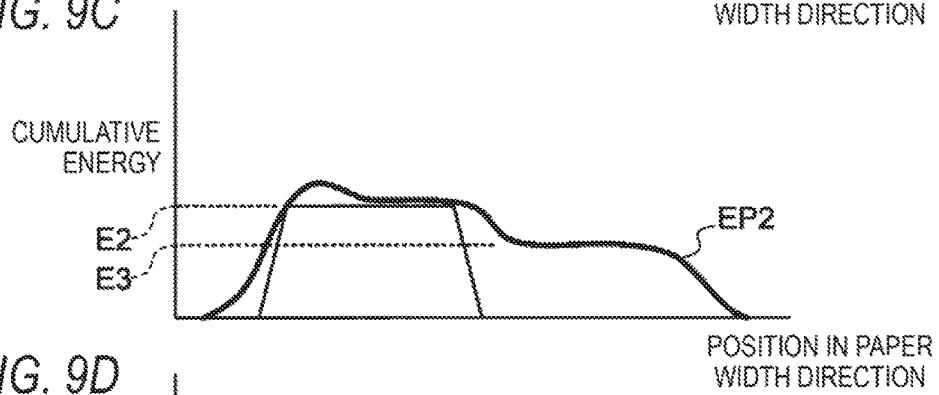

That is, the cumulative energy E1 by the energy profile EP1 in contact with the profile based on the target value is maintained, and the reduction is repeated until the cumulative energy by the other laser element blocks LB with reduced irradiation intensity is brought into contact with the profile based on the target value, and cumulative energy E2 is derived as illustrated in FIG. 9C. Furthermore, the reduction is repeated until the cumulative energy of the other laser element blocks LB is brought into the profile based on the target value. In the example illustrated in FIG. 9C, cumulative energy E3 in the middle of the reduction of the irradiation intensity is illustrated. In such a case, an energy profile EP2 in the paper width direction is obtained.

Figure 9D:
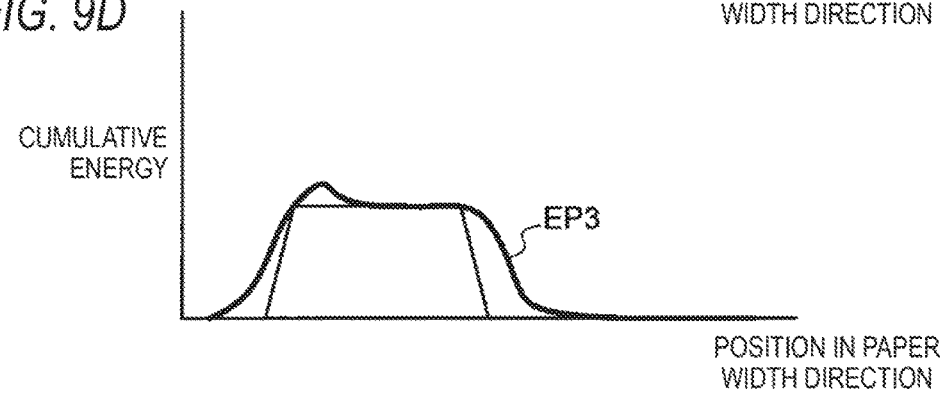

Then, a comprehensive energy profile EP3 in the paper width direction that by the profile based on the target value is derived as illustrated in FIG. 9D. It is possible to derive cumulative energy by the laser beams emitted to the group SPG-H of the sections SP in the paper width direction, that is, the irradiation intensity of the respective laser elements LD included in the laser element blocks LB01 to LB16 from the thus derived energy profile EP3 in the paper width direction.

The aforementioned processing is performed across the paper feeding direction in the image formation region on the continuous-form paper P, that is, for each section SP in the paper feeding direction, and the cumulative energy for the image formation region on the continuous-form paper P Is derived in units in the paper width direction. The thus derived cumulative energy is associated and stored with the respective positions of the sections SP in the RAM 203. Also, it is possible to derive the irradiation intensity of the respective laser elements LD included in the laser element blocks LB01 to LB16 from the derived cumulative energy by using the predetermined feeding speed of the continuous-form paper P. Therefore, the derived irradiation intensity of the laser elements LD may be associated and stored with the respective positions of the sections SP in the RAM 203 instead of the cumulative energy.

Although the case in which the energy profile in the paper width direction is derived until the target value is reached while the irradiation intensity of the laser beams is gradually reduced from the maximum irradiation intensity is described in the exemplary embodiment, a method of deriving the energy profile is not limited thereto. The energy profile in the paper width direction may be derived until the irradiation intensity becomes equal to or greater than the target value while the irradiation intensity of the laser beams is gradually increased from predetermined irradiation intensity such as the minimum irradiation intensity.

Next, in Step S140, the maximum value of the cumulative energy in the paper feeding direction is derived, and an irradiation intensity profile of the laser beams is derived. In the exemplary embodiment, the cumulative energy in the one-dimensional direction in the paper width direction, which has been derived as described above, is used and developed in the paper feeding direction.

That is, in Step S140, the irradiation intensity profile indicating distribution of the irradiation intensity of the laser beams is derived across the paper width direction from the cumulative energy at the respective positions in the paper feeding direction. More specifically, the maximum value of the cumulative energy is derived for the group of the continuing sections SP in the paper feeding direction in the image formation region on the continuous-form paper P first, and the irradiation intensity profile is derived. Then, the deriving of the irradiation intensity provide across the paper width, direction is repeated.

FIG. 8 illustrates an example of a region as target of the deriving of the irradiation intensity profile in the image formation region on the continuous-form paper P. That is, FIG. 8 illustrates an example of the group SPG-V of the continuing sections SP in the paper feeding direction in the image formation region on the continuous-form paper P in a case of deriving the irradiation intensity profile in the paper feeding direction across the paper width direction.

Figure 10A:
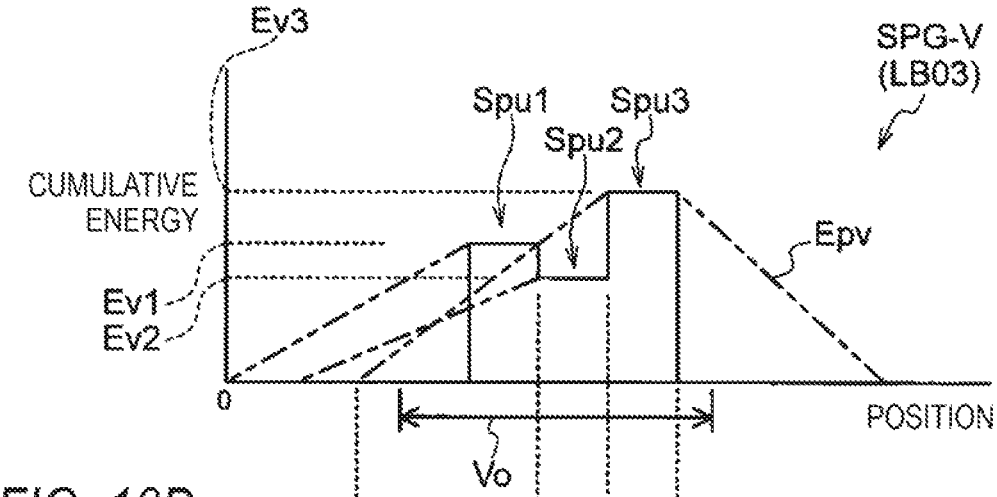
FIGS. 10A, 10B and 10C are diagrams schematically illustrating an example of a process for deriving an irradiation intensity profile by using a maximum value of the cumulative energy.
Figure 10B:
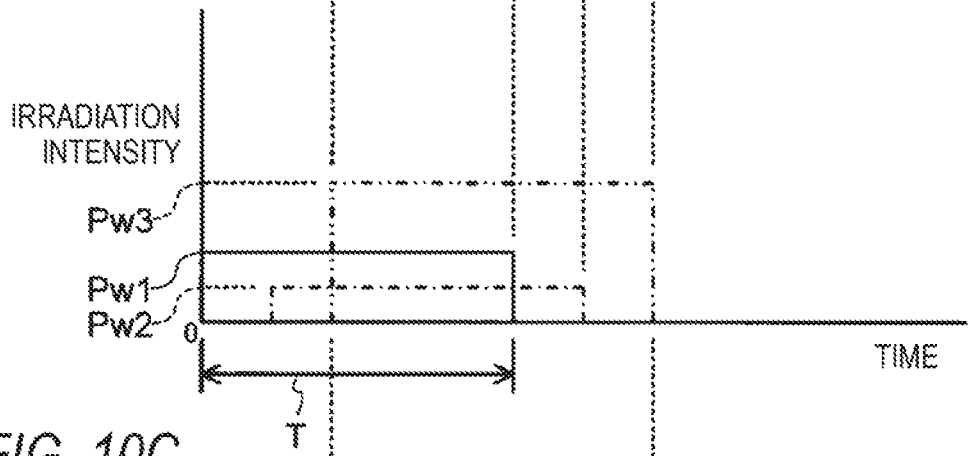
Figure 10C:
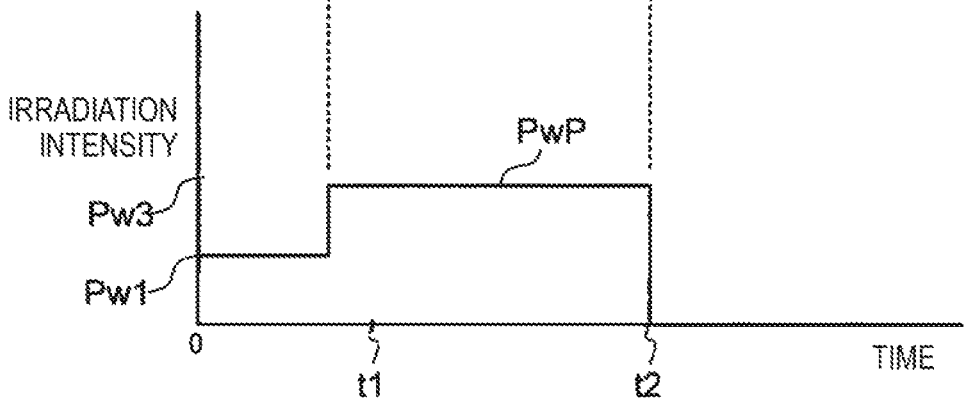

FIGS. 10A to 10C illustrate an example of a process for deriving an irradiation intensity profile for the group SPG-V of the sections SP by using the maximum value of the cumulative energy.

FIG. 10A illustrates an example of distribution of cumulative energy in the group SPG-V of the sections SP corresponding to the laser element block LB03. In the example illustrated in FIG. 10A, cumulative energy is distributed in the order of cumulative energy Ev1, Ev2, and Ev3 corresponding to the sections SPv1, SPv2, and SPv3 from the upstream side in the paper feeding direction. For obtaining the cumulative energy, for example, irradiation intensity of the laser beams emitted from all the laser elements LD included in the laser element block LB03 is accumulated. Therefore, actual cumulative energy corresponds to the property EPv represented by the two-dotted chain line. In such a case, it is necessary to control, the laser elements LD included in the laser element block LB03 in units of the sections SP in the paper feeding direction in order to obtain the cumulative energy Ev1, Ev2, and Ev3, and control of the laser element blocks LB becomes complicated.

Thus, the irradiation intensity profile is derived by using the maximum value of the cumulative energy in the paper feeding direction on the assumption of performing control for each of the laser element blocks LB in the exemplary embodiment. That is, in order to obtain the cumulative energy Ev1, the laser beams at predetermined irradiation intensity are emitted during time T in which the laser element block LB03 passes through the section SPv1, that is, the time (feeding time) T in which the laser beams from the twenty laser elements LB included in the laser element block LB03 are emitted as illustrated in FIG. 10B. As the predetermined irradiation intensity, irradiation intensity by the cumulative energy by averaging the cumulative energy Ev1 in the laser element block LB03 or dividing the cumulative energy Ev1 by the number (twenty) of the laser elements LD may be obtained. Specifically, it is possible to obtain the irradiation intensity Pw1 by dividing the cumulative energy Ev1 by the time T and further dividing the result by the number (twenty) of the laser elements LD.

Also, irradiation intensity Pw2 for obtaining the cumulative energy Ev2 and irradiation intensity Pw3 for obtaining the cumulative energy Ev3 can be obtained in the same manner.

In order to obtain the cumulative energy Ev1, Ev2, and Ev3, the laser elements LD are driven so as to obtain the irradiation intensity Pw1, Pw2, and Pw3 in the laser element blocks LB03 with time as illustrated in FIG. 10B. However, since the twenty laser elements LD included in the laser element block LB03 are driven at the same time, it is difficult to drive the laser element block LB03 so as to obtain the cumulative energy Ev1, Ev2, and Ev3. Thus, the irradiation intensity profile indicating the distribution of the irradiation intensity of the laser beams is derived by using the maximum value of the cumulative energy in the paper feeding direction in the exemplary embodiment.

That is, The irradiation intensity is set so as to be any of the irradiation intensity Pw1, Pw2, and Pw3 as the maximum value of the irradiation intensity corresponding to the maximum value of the cumulative energy Ev1, Ev2, and Ev3, and the irradiation intensity profile PwP indicating the distribution of the irradiation intensity of the laser beams is derived as illustrated in FIG. 10C.

The above processing is performed across the paper width direction in the image formation region on the continuous-form paper P, that is, for each of the sections SP in the paper width direction, and the irradiation intensity profile PwP corresponding to each of the laser element blocks LB is derived. The thus derived irradiation intensity profile PwP is associated and stored with the respective positions of the sections SP in the RAM 203.

Although the case in which degradation of the laser elements is taken into consideration, by averaging the cumulative energy in the laser element blocks LB and suppressing the maximum current is described in the exemplary embodiment, the invention is not limited thereto. For example, the irradiation intensity may be made to vary.

Next, in Step S150, each laser element block LB is driven in accordance with each irradiation intensity profile PwP derived as described above. That is, the irradiation intensity profile for each laser element block LB, which has been derived in Step S140, is read from the RAM 203 first in Step S150. Then, the switching element for driving the laser element block LB is controlled at timing determined by the irradiation intensity profile for each laser element block LB, and the laser element block LB is made to emit laser beams with irradiation intensity determined by the irradiation intensity profile. Thereafter, the program is completed.

Incidentally, if laser element blocks LB at side edges that is, the laser element blocks LB01 and LB16 are in charge of the vicinities of the ink droplet ejection limit positions in the paper width direction in the image formation region, which is formed by the ink droplets ejected by the print heads 50 onto the continuous-form paper P, less laser beams overlap one another in the paper width direction. Therefore, as the drying intensity set as the intensity for drying the ink droplets, the intensity of the laser beams from the laser element blocks LB at the side edges becomes dominant. Therefore, the intensity of the laser beams from the laser element blocks LB at the side edges for obtaining the intensity for drying the ink droplets increases. Therefore, the power consumption by the laser element blocks LB at the side edges increases, and the laser element blocks LB at the side edge more significantly deteriorate than the other laser element blocks LB. In a case where power for obtaining the intensity for drying the ink droplets exceeds an upper limit value of power capable of drying the laser elements in the laser element blocks LB at the side edge, it is not possible to obtain the intensity for drying the ink droplets, and the ink droplets are non-uniformly dried.

Thus, according to the exemplary embodiment, it is possible to locate the laser element blocks LB at the side edges in a region outside the image formation region in the paper width direction such that more laser beams are emitted to the image formation region in the paper width direction in the mutually overlapping manner. That is, it is possible to dispose the laser elements LD inside the image formation region in the paper width direction such that the laser beams of the plural laser elements in at least the paper width direction overlap one another by paying attention to the fact that the laser beams emitted from the laser elements LD expand, that is, by paying attention to the radiation angle of the laser elements LD and how the radiation region expands (on the continuous-form paper P).

Figure 11:
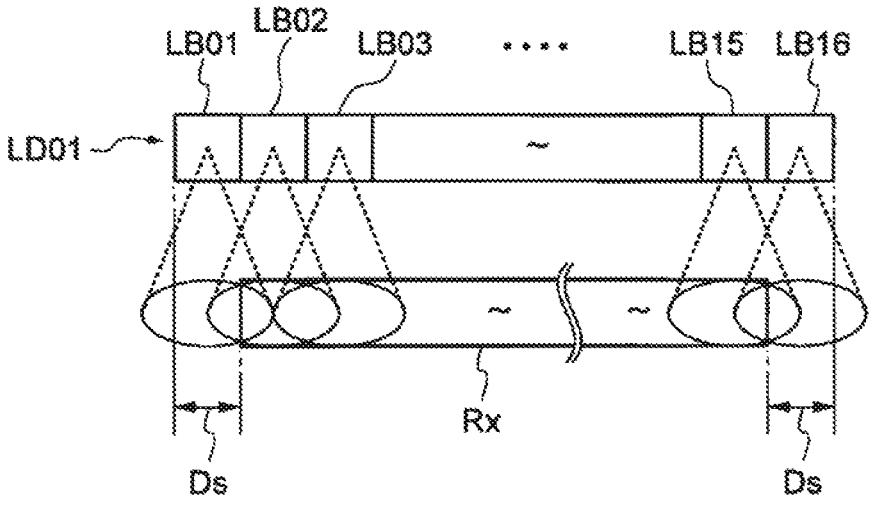
FIG. 11 is a diagram illustrating an example of a positional relationship between the image formation region and the laser element blocks in the paper width direction.

FIG. 11 illustrates an example of a positional relationship between the image formation region and the laser element blocks LB in the paper width direction. In the example illustrated in FIG. 11, the laser element blocks LB (LB01 and LB16) at the side edges are provided at positions away from the image formation region Rx in the paper width direction by a distance Ds in the paper width direction. In this manner, it is possible to case the laser element blocks LB that are in charge of the vicinities of the ink droplet ejection limit positions. This does not lead an increase in power consumption of the laser element blocks LB at the side edges and does not promote the degradation of the laser element blocks LB at the side edges. Also, it is possible to suppress non-uniform drying of the ink droplets.

According to the exemplary embodiment, the cumulative energy is calculated in consideration of the profile of the laser beams at least in the paper width direction as described above. Therefore, it is possible to suppress insufficient cumulative energy even in the end region of the ink image. This makes it possible to suppress the non-uniform drying.

According to the exemplary embodiment, cumulative energy in consideration of the profile of the laser beams in the paper width direction is obtained, irradiation energy profiles in consideration of the profile of the laser beams in the paper feeding direction are obtained, cumulative energy for the ink image on the continuous-form paper P and irradiation intensity of the laser beams for obtaining the cumulative energy are derived in units of the arrangement intervals of the laser elements in the paper width direction and the arrangement intervals of the laser elements in the paper feeding direction, and the maximum value of the irradiation intensity of the laser beams at the same point in time is regarded as a control value. In doing so, it is possible to supply the cumulative energy to be used for drying the ink droplets while suppressing the cumulative energy and thereby to suppress setting of the irradiation intensity of the laser beams to unnecessarily high irradiation intensity including extra intensity.

Furthermore, it is possible to expand the laser arrangement region toward further outside than the drying region on the continuous-form paper P in a case of arranging the laser elements in the paper width direction in the exemplary embodiment. With such a configuration, it is possible to suppress the upper limit of the irradiation intensity of the laser beams in the paper width direction and thereby to prevent the degradation of the laser elements.

According to the exemplary embodiment, the cumulative energy in the one-dimensional direction in the paper width direction is derived with respect to the ink image and is then decided in the paper feeding direction. This makes it possible to simplify the processing of deriving the irradiation intensity profiles of the laser beams for obtaining the target cumulative energy.

According to the exemplary embodiment, the irradiation energy of the laser beams can be accumulated without including laser beams that expand outside the laser unit in the accumulation in a case of accumulating the irradiation energy of the laser beams in the paper feeding direction. This makes it possible to suppress an influence of an error from the target value when the cumulative energy is derived.

Although the invention is described above with reference to the exemplary embodiment, the technical scope of the invention is not limited to the scope of the description of the above exemplary embodiment. Various modifications and improvements can be added to the above exemplary embodiment without departing from the gist of the invention, and the modifications and the improvements are also included in the technical scope of the invention.

Although the exemplary embodiment is described as the case where the drying processing is realized by the software configuration, the invention is not limited thereto, and the drying processing may be realised by a hardware configuration.

As an exemplary structure in this case, a structure is exemplified in which a functional device that executes the same processing as that of the controller 20 is produced and used. In such a case, it is possible to expect an increase in the processing speed in comparison to the above exemplary embodiment.

Although the continuous-form paper P is used as the recording medium in the exemplary embodiment, the type of the recording medium is not limited thereto. For example, a cut paper with a size of A4, A3, or the like may be used. Also, a material of the recording medium is not limited to paper, and a material of a type to which ink droplets are fixed by irradiation with laser beams may be used. Although the exemplary embodiment is designed to aim at drying, even laser irradiation intensity with which the ink droplets are not completely dried can also contribute to an improvement in image quality. Therefore, the cumulative energy set as the target can be changed in accordance with the purpose of improvement.

The type of the laser beams in the exemplary embodiment is not particularly limited. For example, laser elements that emit infrared laser beams with a wavelength in the infrared region or laser elements that emit ultraviolet (UV) laser beams with a wavelength in the ultraviolet region may be used.

What is claimed is:

1. A drying device comprising:

a plurality of laser elements that emit laser beams with controllable intensity and respectively emit the laser beams such that the emitted laser beams partially overlap one another; and a controller that controls the intensity of the laser beams emitted from the plurality of laser elements so as to obtain intensity corresponding to drying intensity set as intensity for drying liquid droplets in a case where at least a part of an image region formed by the liquid droplets ejected in accordance with image information is included in an irradiation region of the laser beams emitted from the plurality of laser elements, the controller controlling the intensity of the respective laser beams, with which an edge of the image region is irradiated, so as to obtain an intensity that is greater than the intensity corresponding to the drying intensity set as an intensity for drying liquid droplets at the edge of the image region included in the irradiation region of the laser beam.

2. The drying device according to claim 1, wherein the controller performs control so as to dry the liquid droplets while moving the image region relative to the plurality of laser elements.

3. The drying device according to claim 2, wherein in a case where a plurality of drying intensities are set as the intensity for drying the liquid droplets included in the image region, the controller controls the intensity of the respective laser beams for irradiating the respective liquid droplets, for which the plurality of drying intensities are set, in the image region so as to obtain intensity corresponding to common drying intensity derived based on the plurality of drying intensities.

4. The drying device according to claim 1, wherein in a case where a plurality of drying intensities are set as the intensity for drying the liquid droplets included in the image region, the controller controls the intensity of the respective laser beams for irradiating the respective liquid droplets, for which the plurality of drying intensities are set, in the image region so as to obtain intensity corresponding to common drying intensity derived based on the plurality of drying intensities.

5. The drying device according to claim 1, wherein the plurality of laser elements are aligned in a laser element array in a predetermined direction so as to be longer than a width of the image region in the predetermined region, or aligned in a first laser element array aligned in a predetermined direction and in a second laser element array aligned in a direction intersecting the predetermined direction.

6. A computer readable medium storing a program that causes a computer to function as respective parts of the drying device according to claim 1.

7. The drying device according to claim 1, wherein the controller divides the irradiation region of the laser beams into a plurality of sections whose numbering is equal to or greater than a number of the plurality of laser elements, calculates, for each of the plurality of sections, a cumulative energy which is a product of an intensity of the laser beams and an irradiation time of the laser beams needed to dry the liquid droplets and sets the intensity of the laser beams emitted from each of the plurality of laser elements based on the cumulative energy.

8. The drying device according to claim 7, wherein the controller sets an initial value of the cumulative energy based on a maximum intensity of the laser beams at a maximum duty for turning on and off the plurality of laser elements and a speed at which the image region is moved, and the controller derives the intensity of the laser beams by reducing the initial value of the cumulative energy so as not to fall below a target cumulative energy which is a minimum energy needed to dry the liquid droplets.

9. A drying method comprising: respectively emitting laser beams such that the emitted laser beams partially overlap one another, with a plurality of laser elements that emit laser beams with controllable intensity, wherein the drying method controls the intensity of the laser beams emitted from the plurality of laser elements so as to obtain intensity corresponding to drying intensity set as intensity for drying liquid droplets in a case where at least a part of an image region formed by the liquid droplets ejected in accordance with image information is included in an irradiation region of the laser beams emitted from the plurality of laser elements, and controls the intensity of the respective laser beams, with which an edge of the image region is irradiated, so as to obtain an intensity that is greater than the intensity corresponding to the drying intensity set as an intensity for drying liquid droplets at the edge of the image region included in the irradiation region of the laser beam.

10. An image forming apparatus comprising:

an ejection unit that ejects liquid droplets onto a recording medium in accordance with image information;

a feeding unit that feeds the recording medium;

the drying device according to claim 1; and a controller that controls the ejection unit, the feeding unit and the drying device.

* * * * *